United States Patent [19]

Groos et al.

[11] Patent Number: 4,484,466

[45] Date of Patent: Nov. 27, 1984

[54] DEVICE FOR REMOVING A DIE, A DISCARD AND A CLOSING PLATE FROM AN INDIRECT METAL EXTRUSION PRESS

[75] Inventors: Horst Groos, Metzkausen; Gunther Wintzen, Monchen-Gladbach, both of Fed. Rep. of Germany

[73] Assignee: SMS Schloemann-Siemag Aktiengesellschaft, Dusseldorf, Fed. Rep. of Germany

[21] Appl. No.: 458,834

[22] Filed: Jan. 18, 1983

[30] Foreign Application Priority Data

Jan. 23, 1982 [DE] Fed. Rep. of Germany ..... 3202051

[51] Int. Cl.[3] ..... B21C 35/04

[52] U.S. Cl. ..... 72/255; 72/273.5

[58] Field of Search ..... 72/254, 255, 263, 273.5

[56] References Cited

U.S. PATENT DOCUMENTS

| | | | |
|---|---|---|---|
| 3,530,702 | 9/1970 | De Ridder | 72/255 |
| 4,154,081 | 5/1979 | Boshold | 72/273.5 |
| 4,342,212 | 8/1982 | Sibler | 72/255 |

FOREIGN PATENT DOCUMENTS

| | | | |
|---|---|---|---|
| 35540 | 10/1976 | Japan | 72/273.5 |
| 35541 | 10/1976 | Japan | 72/273.5 |
| 69135 | 10/1977 | Japan | 72/273.5 |
| 112257 | 9/1978 | Japan | 72/255 |
| 2094690 | 9/1982 | United Kingdom | 72/255 |

*Primary Examiner*—Lowell A. Larson

*Attorney, Agent, or Firm*—Holman & Stern

[57] ABSTRACT

After extrusion in an indirect metal extrusion press a removal arm, the end of which carries a holding sleeve for a die, a discard and a closing plate, is swung into the press axis between the billet carrier and the closing ram. The sleeve is divided into two transversely to the press axis. One part is fixed to the arm and clamps the die, while the other part receives the discard and the closing plate and can be displaced axially in the direction of the closing ram from the fixed sleeve part, the discard and the closing plate attached thereto being released. An hydraulically displaceable clamping seat provided on the removal arm and comprising respective pairs of grippers moves from below up to the closing plate and the discard and embraces them. During the operation to shear the discard from the extruded billet present in the clamped die the discard and the closing plate are moved downwards in a controlled manner. After the extruded billet has been extracted, the removal arm which holds the die on the one hand and the discard with the closing plate on the other hand at different heights, swings into its starting position so as to remove the tools and prepare them again in a controlled manner.

7 Claims, 12 Drawing Figures

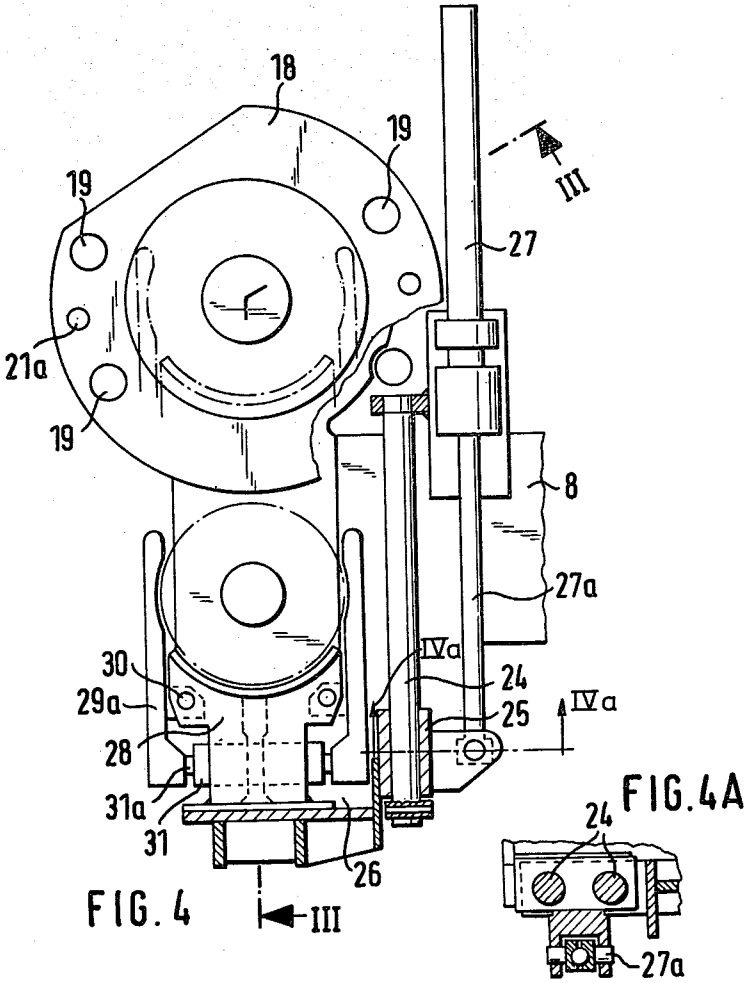
FIG. 4A
FIG. 4
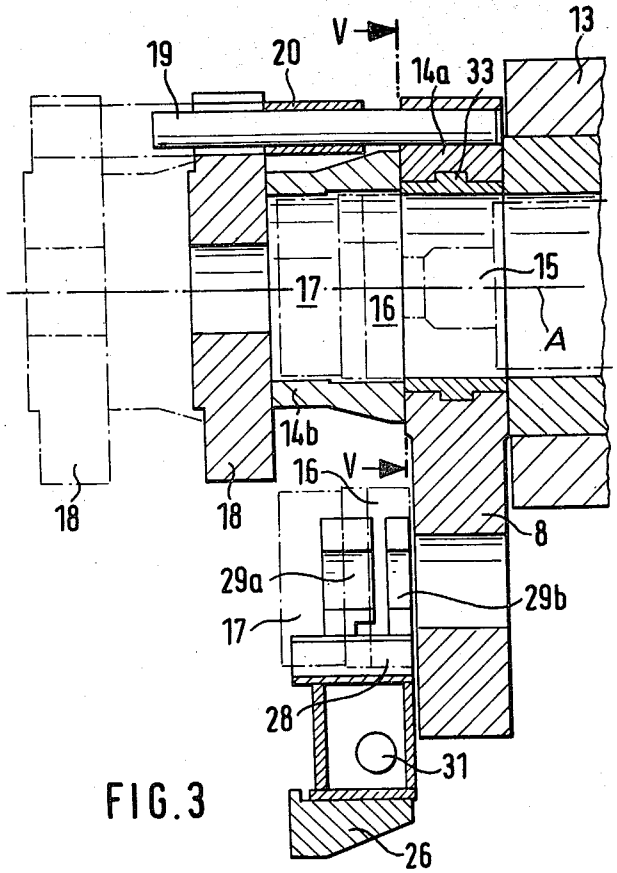
FIG. 3

FIG. 5
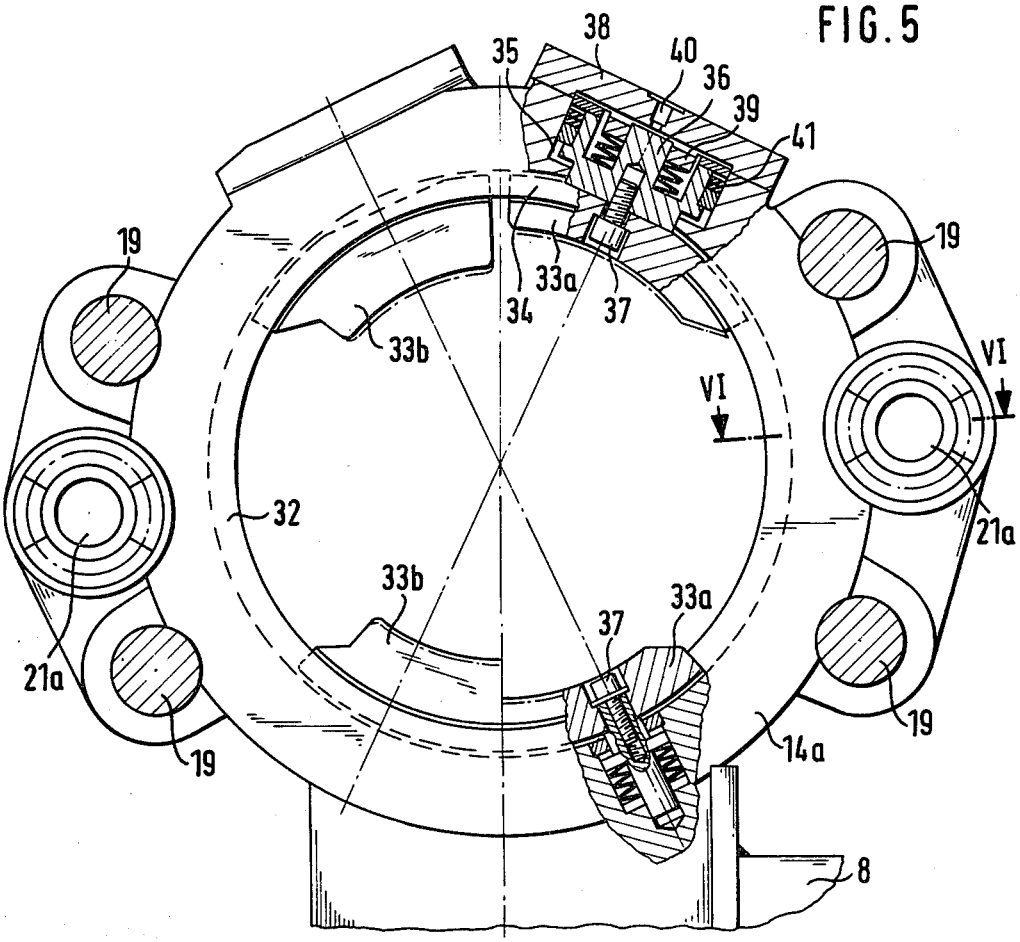
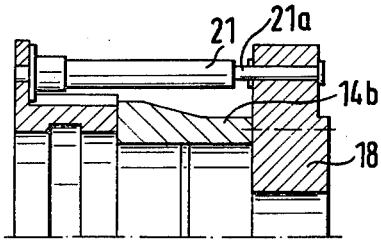
FIG. 6

DEVICE FOR REMOVING A DIE, A DISCARD AND A CLOSING PLATE FROM AN INDIRECT METAL EXTRUSION PRESS

BACKGROUND OF THE INVENTION

1. Field of the Invention

The invention relates to a device for manipulating and removing a die, a discard and a closing plate or disk of different diameters and discard thicknesses from the bore of the billet carrier and from the press itself, after extrusion in an indirect metal extrusion press.

2. Description of the Prior Art

U.S. patent application Ser. No. 356,798, filed Mar. 10, 1982 discloses a removal arm, which can be swung into the press axis and the free end of which carries a one-component or two-component holding sleeve for holding the closing plate, the billet discard and the die. The sleeve end facing the closing ram supports a base plate, and the sleeve is used to strip the tools from the bore of the billet receiver of an indirect metal extrusion press. In the case of the two-component embodiment the sleeve is divided transversely to the press axis, and the sleeve part holding the discard and the closing plate is arranged so as to be either pivotable or displaceable transversely to the press axis on the arm, while the other sleeve part, rigid on the arm, is intended to receive the die.

When shearing off the discard (i.e. the unextruded butt end of the extruded billet) from the die by means of a radially acting shearing device on the billet receiver holder, the discard and the closing plate remain in the sleeve part which is movable transversely to the press axis and is provided with the base plate, and must be axially ejected outside the press.

If the holding sleeve is formed as a single component, it comprises an opening transverse to the sleeve axis and which corresponds to the diameter of the closing plate and at least the thickness of the discard and the closing plate. The discard with the attached closing plate can then be removed from the die through this opening by means of the shearing device. A catching device may be provided beneath the opening.

The mode of operation of the indirect metal extrusion press requires controlled shearing of the discard by a shearing device fitted on the billet carrier holder. After the die, the discard and the closing plate have been ejected from the bore of the billet carrier with the aid of the press force the discard is shorn off from the pressed material in front of the die. In this connection the die must be held and positioned in such a way outside the billet carrier that the discard with the closing plate can be shorn off in a troublefree manner. Since, however, the billet carrier must be operated at temperatures between 300° and 500° C., definite positioning of the die holder and the die presents problems. It is therefore not always possible to ensure that the centre of the holding sleeve of the removal arm matches the press axis. In addition, reliability of operation and a minimum of manipulation are necessary during the automatic operating cycles.

SUMMARY OF THE INVENTION

The object of the invention is to move the die directly and with a minimum of time from the removal arm into a circuit for maintenance purposes in order to be able to return it subsequently to the press. This applies also to the closing plate, i.e. it is necessary to shear the discard in a controlled manner while the die is locked accordingly, even if the billet carrier axis and the axis of the holding sleeve are not exactly in alignment, it then being necessary to move the tools out in a controlled manner.

The object is attained according to the invention in that the holding sleeve which transmits the stripping force for ejecting the closing plate, the discard and the die from the billet carrier and which is divided into two, transversely to the press axis, has one part thereof which is used for holding the discard and the closing plate and is movable away from the other part in the longitudinal direction of the press axis, at least two gripping segments, which are held so as to be freely movable or resiliently and/or hydraulically adjustable radially and are positively located axially, are provided in the opening of the other part of the sleeve, which receives the die, and in addition receiving means for the discard and closing plate comprise a clamping seat with respective pairs of grippers and can be moved, contrary to the shearing direction, into the press axis into the free space formed between the parts of the sleeve when separated, for receiving the discard and the closing plate in a controlled manner during and after the shearing process.

As a result of the present arrangement of the yielding and lockable gripping segments, the stack comprising the closing plate, the discard and the die can easily be moved into the receiving openings of the sleeve parts even when the axes of the billet-receiving bore and the holding sleeve are not in alignment. The die is subsequently held resiliently and is then clamped hydraulically in one sleeve part while the other sleeve part is moved away from the first sleeve part, opposite to the extrusion direction, until the discard and the closing plate are released, projecting freely from the sleeve part which holds the die. Into the free space between the separated sleeve parts moves the clamping seat with a respective pair of grippers for the discard and the closing plate, which embrace both and yield with them outwards away from the press axis in a controlled manner during the continuing shearing process; preferably the clamping seat is below the press axis. In this way the die on the one hand, and the discard and the closing plate on the other, are situated at different heights at which they are removed from the press by the removal arm. After being swung out the die remains at a height which is above that of the closing plate. Both may be moved at these heights outside the press into a circuit for re-use.

Preferably the sleeve part receiving the die is 10 mm longer in the axial direction than the die thickness. This ensures that the die holder, which contains a chamber for receiving the extrusion shell, is completely received in the multiple-component sleeve.

The movable part of the sleeve may be displaced by means of hydraulic power cylinders on guide rods arranged on the fixed part of the sleeve, the interspace between the two separated parts of the sleeve corresponding at least to the axial thickness of the discard and the closing plate. This ensures that the clamping seat with the two pairs of grippers can be safely inserted in the said interspace and the discard and the closing plate can be gripped without difficulty by the clamping seat inserted from below.

Preferably the gripping segments are secured in the die-receiving sleeve part for exchange depending upon the diameter of the die. In this way, dies of different diameter can be resiliently received and hydraulically clamped in the same sleeve part.

In a preferred embodiment the segments are positively located axially in a continuous groove in the sleeve part by means of adapters and are displaceable radially to a limited extent, spring force being produced by means of stacks of cup springs by way of a pressure element, and an hydraulic piston being provided for the hydraulic stressing and radial adjustment of the segments against the spring force. In this way, despite their interchangeability, the segments are held in the sleeve part in a simple and secure manner in order to be able to perform their functions in a trouble-free manner.

In order to grip the discard and the closing plate in a controlled manner, the clamping seat may be moved into the interspace between the two separated parts of the sleeve on guide rods arranged at the free end of the removal arm. In this connection the individual grippers of the clamping seat may be actuated independently of one another. This ensures that the grippers securely grip both the discard and the closing plate in the shearing process and controlled extraction from the press axis.

BRIEF DESCRIPTION OF THE DRAWINGS

One example of the invention is described in greater detail with reference to the drawings, in which:

FIG. 3 is a longitudinal section on an enlarged scale through the free end of the removal arm, in section parallel to the press axis along the line III—III of FIG. 4, where the upper part is shown offset;

FIG. 4 is a view in a direction parallel to the press axis of the components shown in FIG. 3;

FIG. 4A is a section along the line IVa—IVa of FIG. 4;

FIG. 5 is a view on a still larger scale of the sleeve part for holding the die, viewed along the line V—V of FIG. 3 in the direction of the press axis;

FIG. 6 is a section of the two-component sleeve showing an axial displacement device, viewed along the line VI—VI of FIG. 5; and FIGS. 7A to 7E show stages in the operating sequence of the indirect metal extrusion press, in which FIG. 7A is the end of extrusion;

FIG. 7B is the return of the closing ram of the press and swinging of the removal arm with the holding sleeve into the press axis;

FIG. 7C is after moving the tools out of the bore of the billet carrier into the holding sleeve and separation of the parts of the sleeve;

FIG. 7D is the shearing of the discard with the attached closing plate; and

FIG. 7E is the axial displacement of the removal arm and swinging out of the arm and the holding sleeve parts.

DETAILED DESCRIPTION

The invention is applicable to an indirect metal extrusion press of the general construction and operation and set forth in the above mentioned patent application Ser. No. 356,798, to which reference should be made for particulars of the press. The description herein will relate only to such parts of the press and its operation as are necessary for an understanding of the present invention.

Essentially the press comprises a frame composed of a cylinder crosshead, a counter-crosshead or platen, and connecting members between these, and a moving crosshead and a holder for a billet carrier, independently movable along the press frame. The billet carrier has a bore open at both ends and coaxial with the longitudinal axis of the press. The platen carries a hollow stem or ram projecting towards one open end of the billet carrier and the moving crosshead carries a stem or ram projecting towards the other open end of the billet carrier. In operation the free ends of these rams respectively carry a die holder and extrusion die, and a closing plate. A billet is placed in the carrier, the closing plate closes the rear end of the carrier, and the carrier holder and moving crosshead are advanced towards the platen thus forcing the die into the carrier bore and extruding the billet through the die. When extrusion is complete the rear end of the billet carrier bore contains the closing plate, the die, and between these the residual butt end or discard portion of the billet attached to the extruded metal which projects forwards through the die; the die, closing plate and discard have to be separated from the billet carrier, the extruded metal, and each other. As described in the prior patent applications this is effected by expelling or stripping them from the carrier, then shearing transversely to separate the discard and closing plate from the die and extruded metal, after which the extruded metal can be withdrawn or expelled from the die and carrier leaving the die free to be removed.

Figure 2:
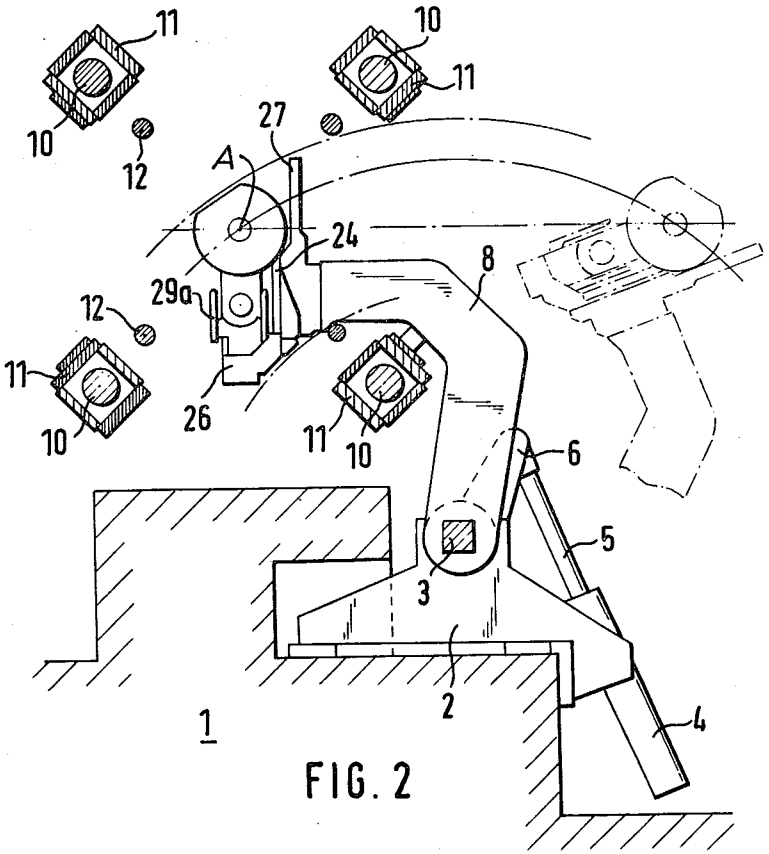
FIG. 2 is a view showing the arm of FIG. 1 and parts of the press, seen at 90° to the view of FIG. 1, i.e. in the direction of the press axis, partially in section.
Figure 1:
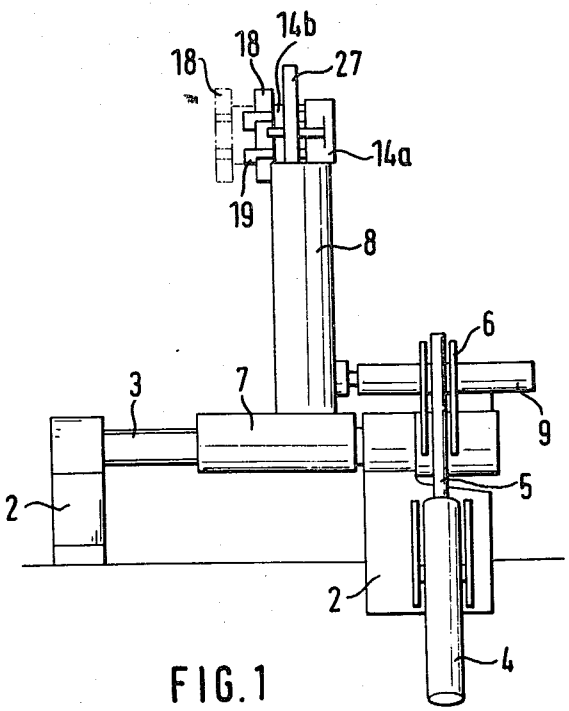
FIG. 1 is a view of a removal arm for the tools of an indirect metal extrusion press, seen at right angles to the press axis.

FIGS. 1 and 2 show generally a device for removing the die and the closing plate and discard, comprising a support block 2 which is mounted on a base 1 and in which a horizontal square shaft 3 is mounted parallel to the press axis A so as to be rotatable. An hydraulic cylinder 4, the piston rod 5 of which is connected in an articulated manner to a lever 6 secured to the square shaft 3, is pivoted on the support block 2. A removal arm 8 is secured to a sliding sleeve 7 which is axially displaceable on the square shaft 3 parallel to the press axis. The said arm 8 is axially displaceable on the square shaft 3 by means of a further horizontal hydraulic cylinder 9 arranged at one end of the square shaft 3. The free end of the arm 8 is swung out into the press axis of the indirect metal extrusion press by means of the hydraulic cylinder 4. Of the indirect metal extrusion press, the pre-stressed connecting members connecting the cylinder cross-head and the counter cross-head and the counter cross-head or platen (not shown), comprising tension members 10 and pressure members 11 surrounding them, are illustrated in section in FIG. 2. In addition, displacement rods 12 for the billet carrier 13 of the press, shown in FIGS. 3 and 7, are shown in section in FIG. 2.

At its free end, which can be swung into the press axis, the arm 8 is provided with a holding sleeve 14 which is used for receiving the extrusion die 15, the discard 16 and the closing plate 17 attached to the latter after the extrusion operation (see also FIG. 7 and dash-dot lines in FIG. 3). The sleeve 14 is divided transversely to the press axis, one sleeve part 14*a* being used for receiving the die 15 and the other sleeve part 14*b* being used for receiving the discard 16 and the closing plate 17 (shown in dash-dot lines in FIG. 3). In addition, a base plate 18 is secured to part 14*b*.

Guide rods 19 parallel to the press axis are provided at the free end of the arm 8. The sleeve part 14*b* together with the base plate 18 is displaceable along the rods 19 on guides 20, by means of hydraulic cylinders 21 and their piston rods 21*a*, axially in the direction of the moving cross-head 22 and the closure ram 23 of the press i.e. opposite to the extrusion direction (FIG. 7) and thus can be separated from the sleeve-shaped part 14*a*, which is rigidly disposed on the arm 8. Part 14*b* together with the base plate 18 can be moved so far away from part 14*a* as to leave a gap at least as wide as the closing plate 17 and the discard 16 (see FIGS. 1 and 3 with dash-dot lines).

In addition, guide rods 24 are secured to the top of the arm 8 so as to be vertical in the swung-in position. A clamping seat 26 is displaceable on these guide rods 24 by means of guide sleeves 25. Displacement is effected by means of an hydraulic cylinder 27 which is provided on the arm 8 and the piston rod 27*a* of which is connected to the guide sleeves 25 in an articulated manner.

The clamping seat 26 supports a receiving device 28 which is concave at the top for receiving the discard 16 and the closing plate 17. Respective pairs of grippers 29*a* and 29*b* are provided on the receiving device 28 on the right and the left. They are articulated at their centres on the receiving device 28 by pins 30. The lower parts of the pairs of grippers 29*a* and 29*b* are connected to the piston 31*a* of an hydraulic cylinder 31 which is secured horizontally in the lower part of the clamping seat 26. When the said hydraulic cylinder 31 is pressurised hydraulically the pairs of grippers 29*a* and 29*b* are actuated independently of one another to grip the released closing plate 17 and the discard 16 respectively after the clamping seat 26 has been lifted towards the press axis (FIGS. 3 and 4).

The fixed part 14*a* of the holding sleeve for receiving the die 15 is illustrated in FIG. 5 on a larger scale. The opening in the part 14*a*, which is rigidly secured to the arm 8, is provided with a continuous circumferential groove 32, in which gripping segments 33*a* are held with positive axial location by means of adapters or keys 34. Outwardly open cylindrical recesses 35 are provided in the fixed part 14*a*. In recesses 35, pressure elements 36 are radially slidably disposed and are attached to the segments 33*a* by screws 37 in such a way that segments 33*a* are displaceable radially outwardly to an extent limited by the inner wall of the fixed part 14*a*. The pressure elements 36 are closed in by covers 38 arranged on the fixed part 14*a*. Stacks of cup springs 39, which hold the pressure elements 36 and the segments 33*a* connected thereto so as to be resilient radially to a limited extent, are interposed between each pressure element 36 and its cover 38. By these means a die 15 inserted in the fixed sleeve part 14*a* may be clamped resiliently. In order to clamp the die 15 firmly by the segments 33*a* an hydraulic pressure is applied between the covers 38 and the pressure elements 36 by way of connecting sockets 40, the pressure elements 36 in the cylindrical recesses 35 acting as pistons and being sealed in the recesses by means of packings 41.

If other dies 15 with a smaller diameter are used for extrusion, the segments 33*a* may be exchanged for segments 33*b* which are larger in radial extent (FIG. 5).

FIG. 6 is an axial section, again on an enlarged scale, of the sleeve 14 with the fixed part 14*a* and the part 14*b* displaceable away from the latter in the axial direction by means of the hydraulic cylinder 21 and including the base plate 18 to which the piston rod 21*a* of the hydraulic cylinder 21 is secured.

Figure 7A:
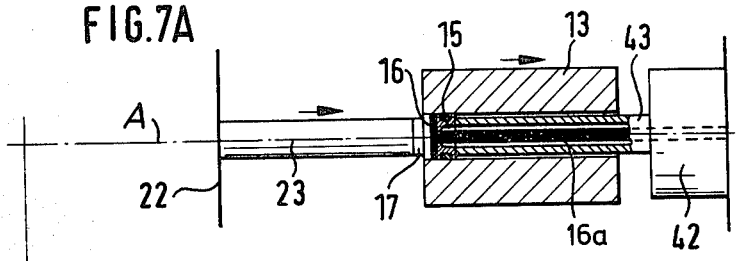

FIGS. 7A to 7E illustrate an operating cycle in indirect metal extrusion after the end of the extrusion operation. FIG. 7A shows very diagrammatically a die crosshead or counter crosshead or platen 42 of an indirect metal extrusion press, on which is supported a ram 43 the head of which carries the die 15. After the extrusion operation has been concluded the billet carrier 13 encloses the ram 43, and the discard 16 with the extruded billet 16*a* still attached is situated between the die 15 and the closing plate 17 which is pressed in the direction of the arrow against the discard by means of the travelling crosshead 22 and the closing ram 23 connected thereto.

Figure 7B:
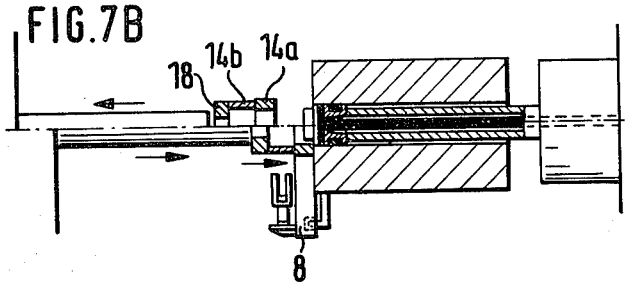

As shown in FIG. 7B the travelling crosshead 22 together with the closing ram 23 returns towards the left, after which the arm 8 together with the holding sleeve parts 14*a* and 14*b* swings into the press axis in order to receive the die 15, the discard 16 and the closing plate 17. Then the closing ram 23 moves forward towards the right and abuts against the base plate 18 and thus presses the billet carrier 13 towards the right by way of the said base plate 18 and the sleeve 14. This effects stripping or release of the extrusion tools from the billet carrier and expulsion of them into the sleeve 14.

Figure 7C:
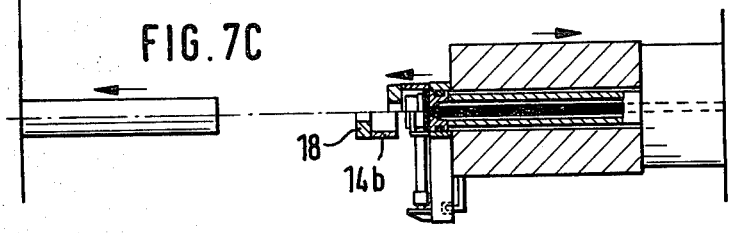

FIG. 7C shows the return of the closing ram 23 and the displacement of part 14*b* towards the left, leaving the discard and closing plate projecting freely from the fixed sleeve part 14*a*. The clamping seat 26 together with the pairs of grippers 29*a* and 29*b* then moves upwards to grip the thus exposed closing plate 17 and the discard 16.

Figure 7D:
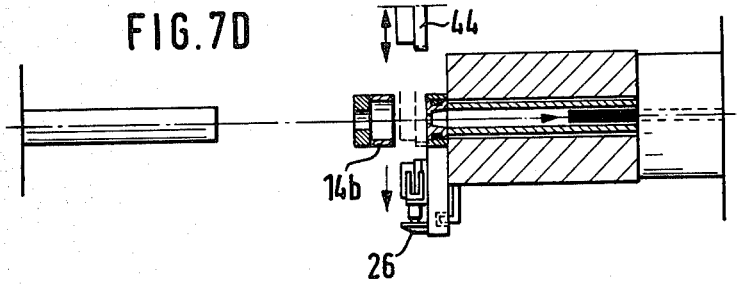

FIG. 7D shows the shearing of the discard 16 from the billet 16*a* on the clamped die 15 by means of a radially moving shearing device 44 while the closing plate 17 and the discard 16 are under controlled clamping, as the clamping seat 26 descends. The extruded metal is now free to be extracted from the die and billet carrier.

Figure 7E:
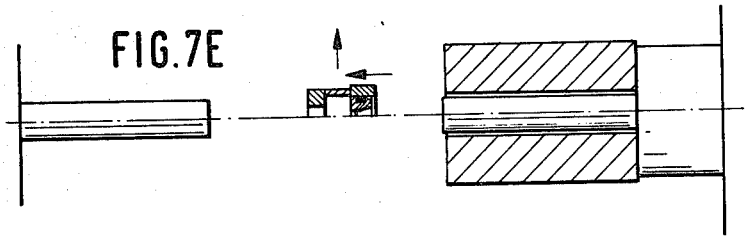

In FIG. 7E the arm 8, together with the die 15 held in the sleeve part 14*a* and the closing plate 17 and the discard 16 held in the clamping seat 26 (not shown) in the pairs of grippers 29*a* and 29*b*, is first displaced axially and then swung out of the press axis in order to remove the tools and to prepare them again.

We claim:

1. In an indirect extrusion press comprising a press frame having a press axis, a billet carrier movable along the press axis and having opposite open ends, a stationary die support facing one open end of the billet carrier and carrying an extrusion die in operation disposed for movement of the billet carrier along and over said die, a movable crosshead facing the opposite open end of the billet carrier and carrying a closing plate in operation for closing the said opposite open end when a billet is disposed in the carrier for extrusion through the extrusion die, a movable holder for the billet carrier for moving the billet carrier over the extrusion die, and a shearing device mounted on the said holder and operating in a direction transverse to the press axis for separating the extruded billet material from residual discard material comprising a butt end portion of the billet and from the extrusion die and closing plate adjoining the said discard after extrusion, the improvement comprising: a pivotable removal arm having a free end which by pivoting of the arm is movable to and away from the axis of the press, the arm being mounted for movement parallel to the said press axis; a two-part holding sleeve carried at the free end of the pivotable arm and thereby disposable adjacent to the said opposite open end of the billet carrier, the holding sleeve being at least partly closed at an end thereof remote from the billet carrier and being adapted to press against the billet carrier under pressure exerted by the press thereby to expel the closing plate, the butt end discard and the extrusion die from the billet carrier into the holding sleeve; means for effecting axial relative movement of the two parts of the holding sleeve whereby a first said part serving to hold the closing plate and said discard can, after said expulsion be axially separated from the other said part which serves to hold the die; at least two gripping segments which project into the said other part, are positively located axially and are radially movable for gripping said die; and means for receiving the separated closing plate and discard, comprising a clamping seat, means for moving the clamping seat to a first position between the said parts on axial separation of said parts and to a second position radially offset from the said parts, the direction of movement of the clamping seat being generally aligned with that of the shearing device, and gripping means associated with the clamping seat for gripping the closing plate and discard separated by the shearing device from the extruded material and the die.

2. A press according to claim 1, characterised in that the said other holding sleeve part which receives the die is up to 10 mm longer in the axial direction than the thickness of the die.

3. A press according to claim 1, characterised in that the means for axial movement of the movable first part of the holding sleeve are hydraulic power cylinders, guide rods are arranged on the other part of the holding sleeve and the interspace between the two parts of the holding sleeve when separated corresponds at least to the thickness of the discard and the closing plate.

4. A press according to claim 1, characterised in that the gripping segments are interchangeably secured in the said other part of the holding sleeve whereby different segments can be substituted depending upon the diameter of the die.

5. A press according to claim 1, characterized in that the gripping segments are held with positive axial location, in a continuous circumferential groove provided in the said other holding sleeve part by means of adapters and are displaceable radially to a limited extent, and are provided with radial stacks of cup springs and pressure elements, and a hydraulic piston is provided for hydraulic stressing and radial adjustment of each segment against the spring force of said cup springs.

6. A press according to claim 1, characterised in that guide rods are provided on the free end of the removal arm along which rods the clamping seat may be moved to the press axis into the interspace formed between the two parts of the holding sleeve when separated axially.

7. A press according to claim 1, wherein said gripping means associated with the clamping seat comprises individual grippers supported on the clamping seat and adapted to be actuated independently of one another for gripping respectively said closing plate and discard.

* * * * *